US006093028A

United States Patent [19]

Yang

[11] Patent Number: 6,093,028

[45] Date of Patent: Jul. 25, 2000

[54] NIGHT LAMP WITH SIDE MOUNTING TYPE ROTARY POWDER INPUT PLUG

[76] Inventor: Wen-Yuan Yang, No. 32, Bao-Hsan Rd., Hsinchu, Taiwan

[21] Appl. No.: 09/275,964

[22] Filed: Mar. 25, 1999

[51] Int. Cl.[7] ..... H01R 39/00

[52] U.S. Cl. ..... 439/13; 439/11; 362/226

[58] Field of Search ..... 439/20–22, 27, 439/13, 18, 19, 23–26, 11; 362/226, 287

[56] References Cited

U.S. PATENT DOCUMENTS

| | | | |
|---|---|---|---|
| 3,092,695 | 6/1963 | Abrams | 439/11 |
| 5,352,122 | 10/1994 | Speyer et al. | 439/27 |
| 5,683,254 | 11/1997 | Lin | 439/11 |
| 5,711,674 | 1/1998 | Chu | 439/11 |
| 5,727,953 | 3/1998 | Pasholk | 439/21 |

*Primary Examiner*—Gary F. Paumen
*Attorney, Agent, or Firm*—Rosenberg, Klein & Lee

[57] ABSTRACT

A night lamp, which includes a lamp socket holding a bulb, and a power input plug fastened to the lamp socket at one side for power input, wherein the power input plug includes a body coupled to lamp socket at one side to hold two metal blades for insertion into an electric outlet and an annular metal contact plate and a center metal contact plate at its back side wall in connection to the metal blades respectively, and two locating blocks securely fastened to the lamp socket at one side to hold the body in place, enabling the annular metal contact plate and the center metal contact plate to be maintained in contact with a respective metal contact plate in the lamp socket, the locating blocks each having a coupling flange respectively coupled to an annular coupling groove at the periphery of the body for enabling the body to be rotated on its own axis between the locating blocks to adjust relative to the lamp socket.

1 Claim, 4 Drawing Sheets

NIGHT LAMP WITH SIDE MOUNTING TYPE ROTARY POWDER INPUT PLUG

BACKGROUND OF THE INVENTION

The present invention relates to a night lamp, and more particularly to such a night lamp which is comprised of a lamp socket, and a rotary power input plug coupled to the lamp socket at one side for connection to an electric outlet to receive power supply.

A regular night lamp is generally comprised of a lamp socket for holding a bulb, and a power input plug fixedly connected to the lamp socket at one side for connection to an electric outlet to receive power supply. Because the angular position of the power input plug is not adjustable, it is inconvenient to install the night lamp in a narrow installation area, and the night lamp may be hindered by furniture from installation in an electric outlet.

SUMMARY OF THE INVENTION

The present invention has been accomplished to provide a night lamp which eliminates the aforesaid problem. It is therefore the main object of the present invention to provide a night lamp that can be adjusted to change its power input plug to the desired angular position for installation in an electric outlet in a narrow area. To achieve this and other objects of the present invention, there is provided a night lamp comprised of a lamp socket holding a bulb, and a power input plug fastened to the lamp socket at one side for power input, wherein the power input plug comprises a body coupled to lamp socket at one side to hold two metal blades for insertion into an electric outlet and an annular metal contact plate and a center metal contact plate at its back side wall in connection to the metal blades respectively, and two locating blocks securely fastened to the lamp socket at one side to hold the body in place, enabling the annular metal contact plate and the center metal contact plate to be maintained in contact with a respective metal contact plate in the lamp socket, the locating blocks each having a coupling flange respectively coupled to an annular coupling groove at the periphery of the body for enabling the body to be rotated on its own axis between the locating blocks to adjust relative to the lamp socket.

DETAILED DESCRIPTION OF THE PREFERRED EMBODIMENT

Figure 1:
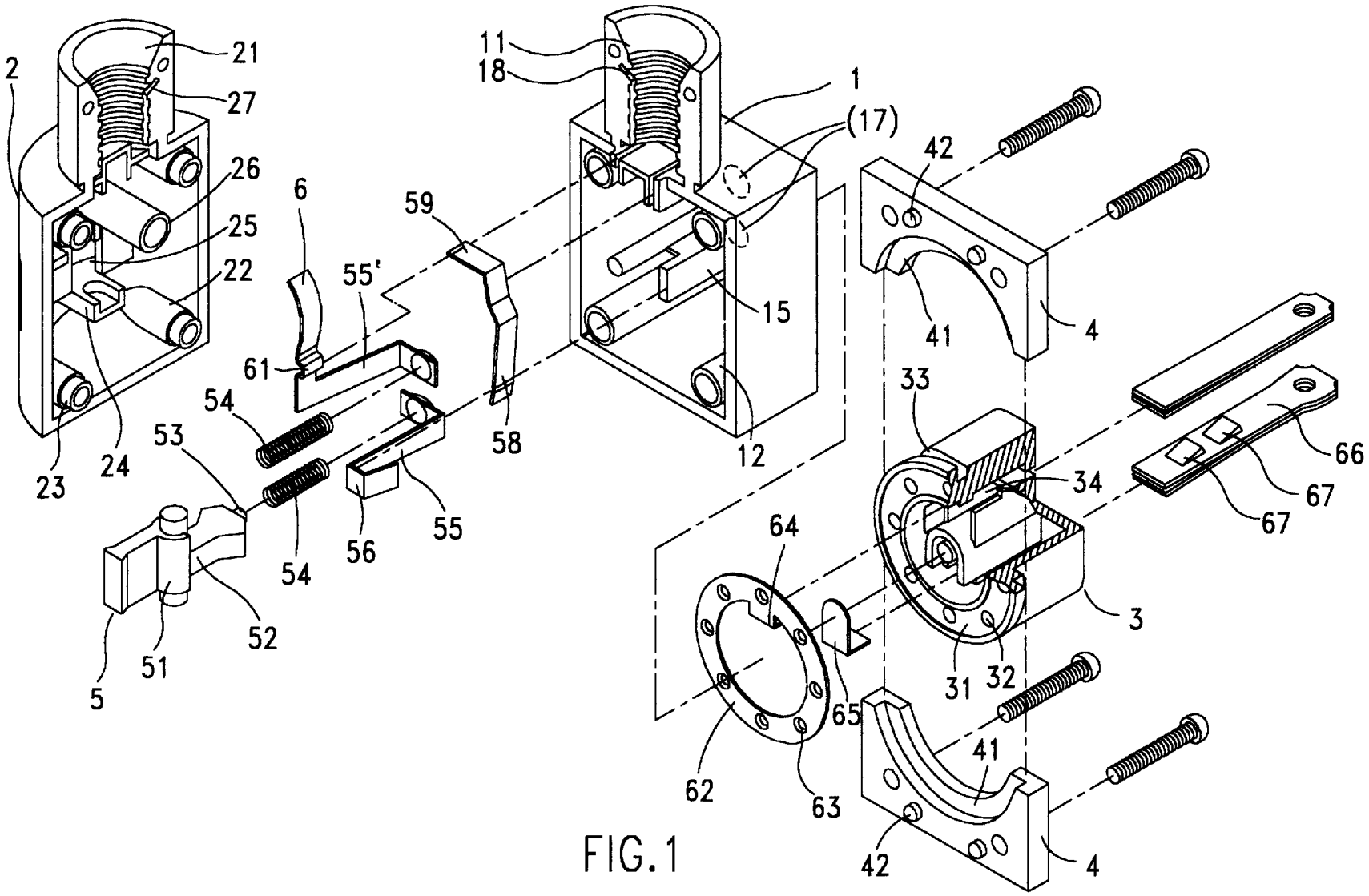
FIG. 1 is an exploded view of a night lamp according to the present invention.

Referring to Figures from 1 through 3, a night lamp is shown comprised of a lamp socket, which is comprised of a first shell 1 and a second shell 2, and a rotary power input plug, which is comprised of a body 3, an annular metal contact plate 62, a center metal contact plate 65, and two blades 66, and two locating blocks 4 securely fastened to the lamp socket at one side to hold the rotary power input plug in place.

Figure 2:
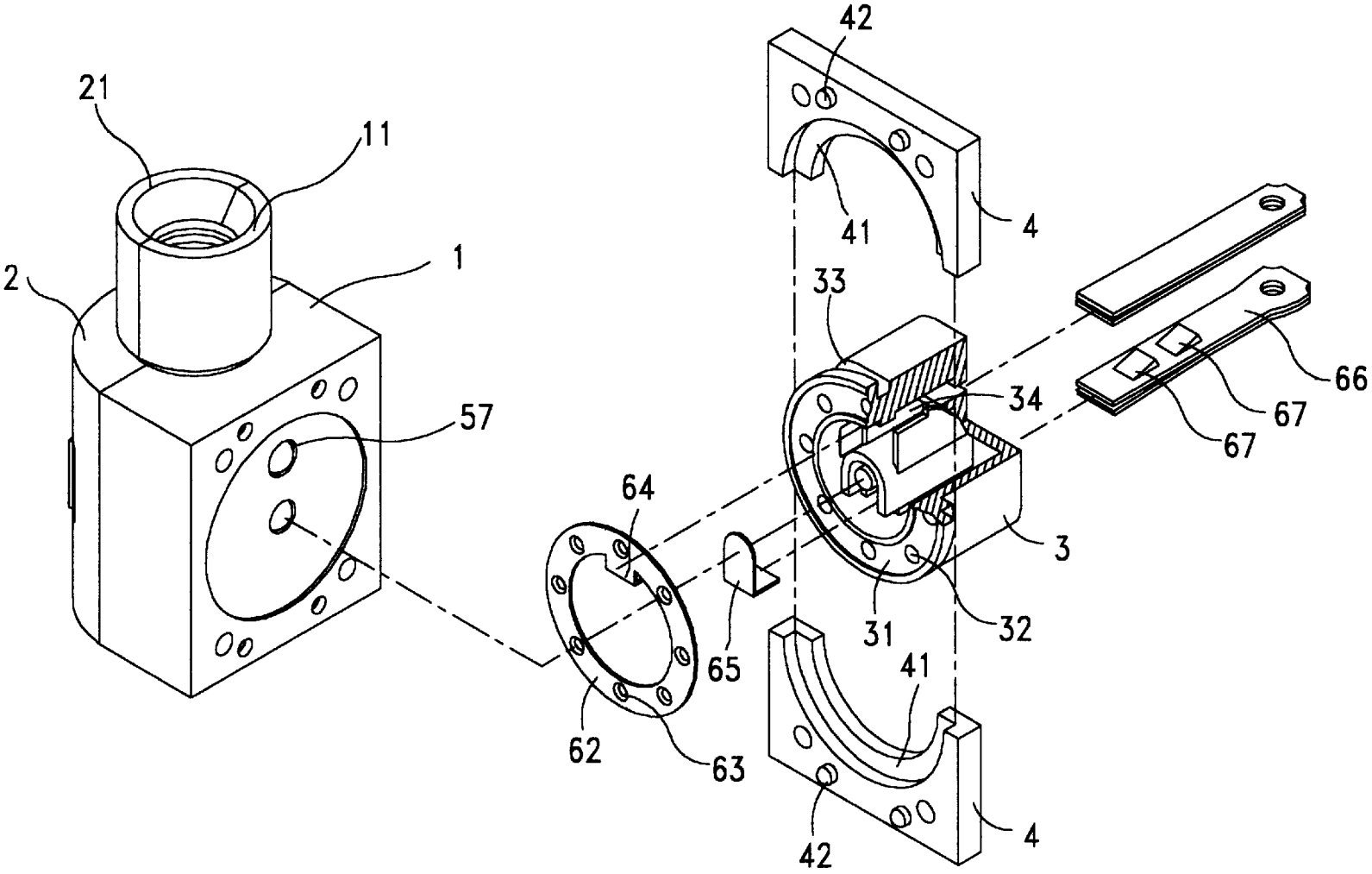
FIG. 2 is another exploded view of the present invention, showing the lamp socket assembled.

Referring to FIGS. 1 and 2 again, the first shell 1 comprises a plurality of mounting barrels 12 disposed in four corners thereof on the inside, a locating rod 13 disposed on the inside, two through holes 17 at a front side wall thereof, an internally threaded neck 11 of semi-circular cross section raised from a top side wall thereof, and a locating notch 18 inside the neck 11. The second shell 2 comprises a plurality of mounting barrels 22 and 23 respectively fastened to the mounting barrels 12 at the first shell 1 by screws, a spring holder 26 on the inside, two axle bearings 24 vertically aligned on the inside, an opening 25 through the peripheral wall thereof at an elevation between the axle bearings 24, an internally threaded neck 21 of semi-circular cross section raised from a top side wall thereof, and a locating notch 27 inside the neck 21. A center terminal 58 is fastened to the first shell 1 on the inside, having a flat contact portion 59 suspended in the neck 11 at a bottom side for the contact of the tip contact of a bulb. A side terminal 6 is fastened to the locating notch 18 at the neck 11 of the first shell 1 and the locating notch 27 at the neck 21 of the second shell 2 for the contact of the ring contact of a bulb. The side terminal 6 has a corrugated bottom end 61. A first metal contact plate 55 and a second metal contact plate 55' are fastened to the first shell 1 on the inside. The first metal contact plate 55 has a hooked rear end 56 fastened to the locating rod 15 inside the first shell 1. The first metal contact plate 55 and the second metal contact plate 55' each have a respective front end terminating in a respective raised contact portion 57. The raised contact portions 57 of the metal contact plates 55 and 55' are respectively forced into the through holes 17 at the first shell 1 to make a respective contact with the power input plug 3. The corrugated bottom end 61 of the side terminal 6 is connected to the rear end of the second metal contact plate 55'. A switch lever 5 is extended out of the opening 25 at the second shell 2 for operation by hand to control the connection between the first metal contact plate 55 and the center terminal 58. The switch lever 5 comprises a fixed transverse pivot 51 supported in the axle bearings 24 inside the second shell 2, and a locating rod 53 at its one side inside the second shell 2. Two spring elements 54 are respectively mounted on the locating rod 53 at the switch lever 5 and in the spring holder 26 at the second shell 2, and respectively pressed at the front ends of the metal contact plates 55 and 55' to force the raised contact portions 57 of the metal contact plates 55 and 55' into the through holes 17 at the first shell 1.

Figure 3:
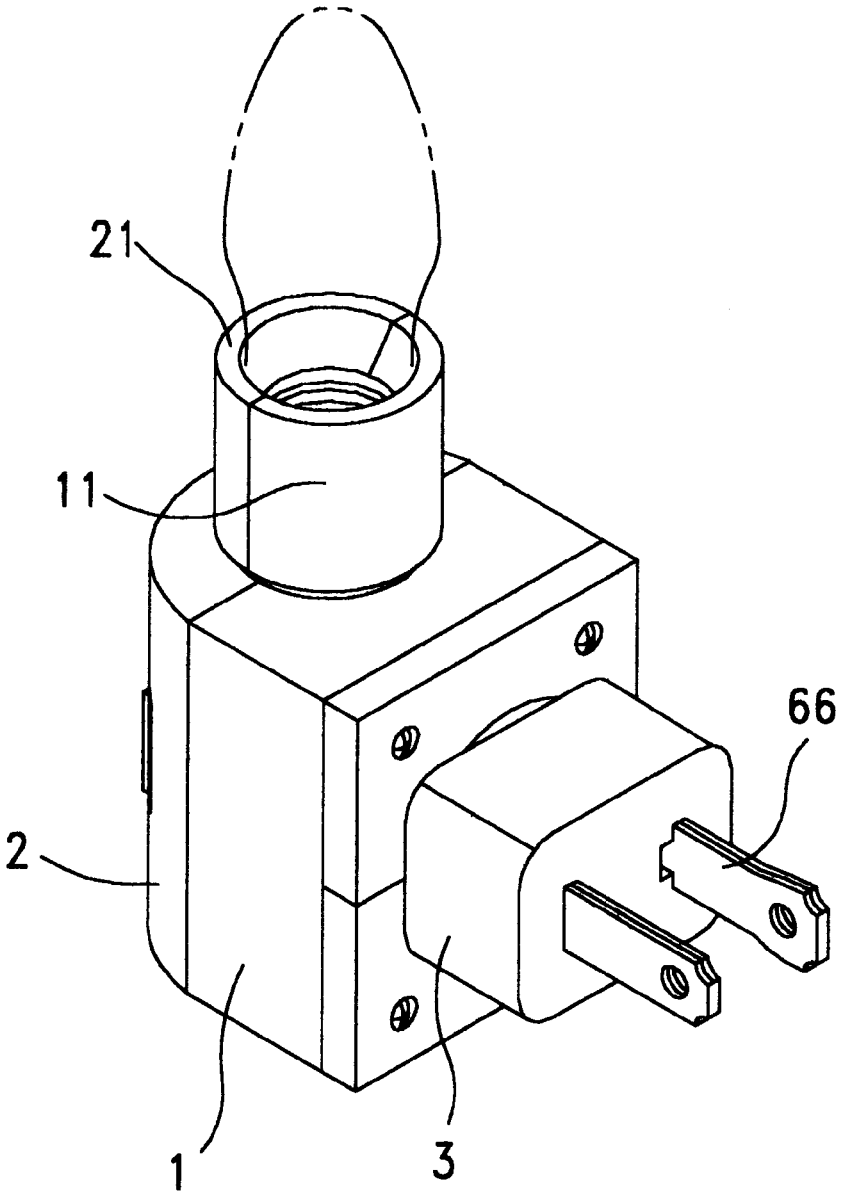
FIG. 3 shows the nigh lamp assembled according to the present invention.

Referring to FIGS. 2 and 3 again, the body 3 comprises an annular recess 31 at its back side wall, a plurality of recessed portions 32 equiangularly spaced in the annular recess 31, an annular coupling groove 33 around the periphery near its back side wall, and two axially extended insertion slots 34. The annular metal contact plate 62 is mounted within the annular recess 31 in a flush manner, having a plurality of raised portions 63 respectively engaged into the recessed portions 32 in the annular recess 31, and a protruded portion 64 engaged into one insertion slot 34. The center metal contact plate 65 is securely fastened to the back side wall of the body 3 at the center and partially engaged into one insertion slot 34. The blades 66 are respectively mounted in the insertion slots 34 at the body 3, and respectively connected to the protruded portion 64 of the annular metal contact plate 62 and the center metal contact plate 65, each having a plurality of projecting portions for positive positioning in the insertion slots 34. The locating blocks 4 are securely fastened to the first shell 1 at one side to hold the body 3 in place, enabling the annular metal contact plate 62 and the center metal contact plate 65 to be maintained in contact with the raised contact portions 57 at the metal contact plates 55' and 55, each having a coupling flange 41 respectively coupled to the annular coupling groove 33 at the body 3 for enabling the body 3 to be rotated on its own axis between the locating blocks 4 relative to the lamp socket. The locating blocks 4 further comprise a plurality of positioning pins 42 respectively press-fitted into respective plug holes at the first shell 1 of the lamp socket.

Figure 4:
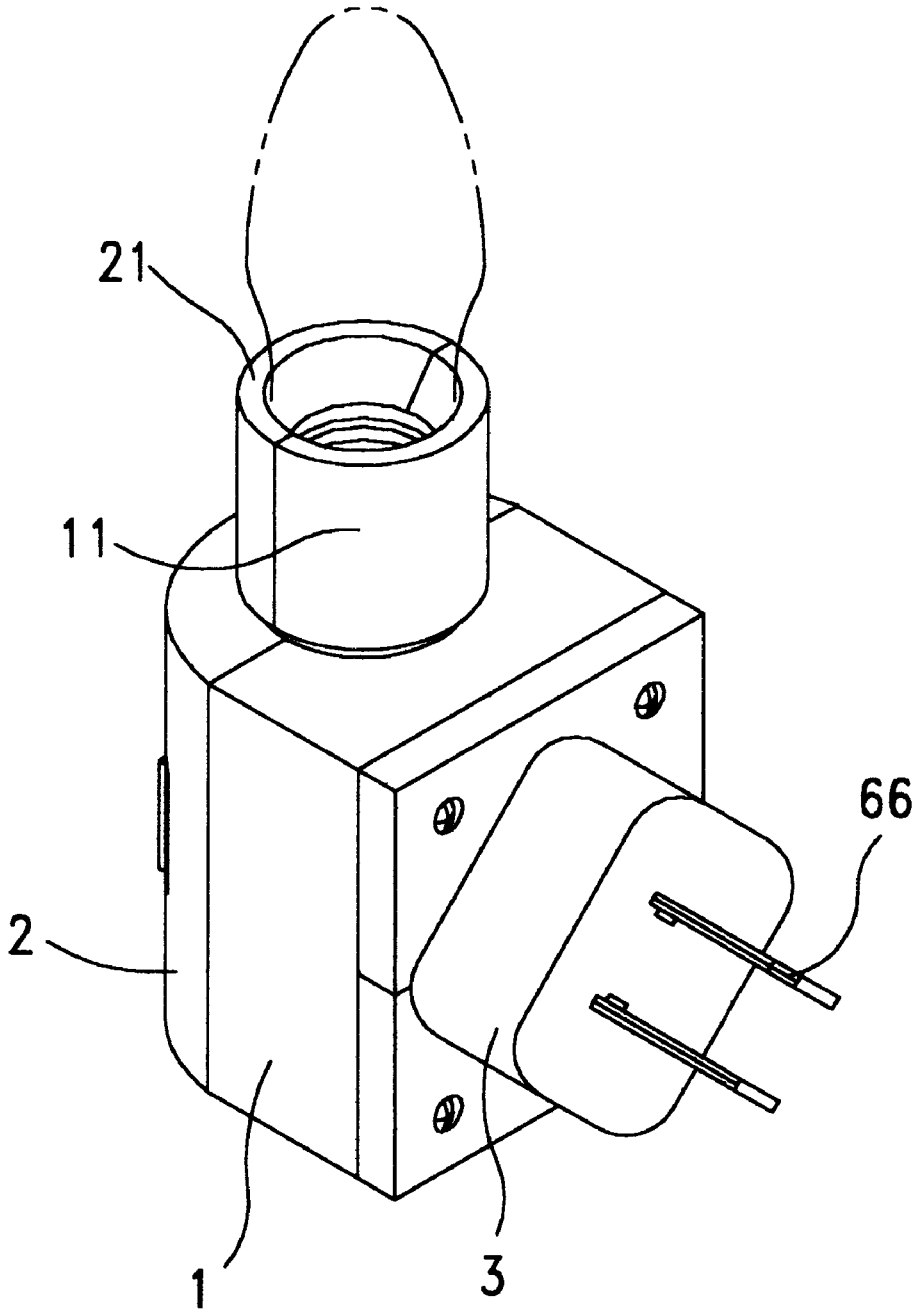
FIG. 4 is similar to FIG. 3 but showing the angular position of the body of the power input plug adjusted.

Referring to FIG. 4 and FIG. 2 again, the body 3 of the power input plug can be rotated on its own axis between the locating blocks 4 to change its angular position relative to the lamp socket. When the body 3 is rotated on its own axis, the annular metal contact plate 62 and the center metal contact plate 65 are constantly maintained in contact with the raised contact portions 57 at the metal contact plates 55' and 55 of the lamp socket. When the blades 66 are inserted into an electric outlet, electricity is guided to the lamp socket to turn on the bulb in the lamp socket.

What the invention claimed is:

1. A night lamp comprising a lamp socket holding a bulb, and a power input plug mounted on said lamp socket at one side thereof for connection to an electric outlet to transmit electricity from said electric outlet to the bulb at said lamp socket through two metal contact plates in said lamp socket, wherein said power input plug comprises:

a body coupled to said lamp socket at one side, thereof said body comprising an annular recess at a back side wall thereof, an annular coupling groove around the periphery thereof near said back side wall, and two axially extended insertion slots;

an annular metal contact plate securely mounted within the annular recess at said body and disposed in contact with one of the metal contact plates in said lamp socket, said annular metal contact plate having a protruded portion engaged into one of said insertion slots;

a center metal contact plate securely fastened to the back side wall of said body at the center and partially engaged into one of said insertion slots;

two metal blades respectively mounted in the insertion slots at said body and respectively connected to the protruded portion of said annular metal contact plate and said center metal contact plate; and two locating blocks securely fastened to said lamp socket at one side to hold said body in place, enabling said annular metal contact plate and said center metal contact plate to be maintained in contact with the metal contact plates in said lamp socket, said locating blocks each having a coupling flange respectively coupled to the annular coupling groove at said body for enabling said body to be rotated on its own axis between said locating blocks to adjust relative to said lamp socket.

* * * * *